US005313981A

United States Patent [19]

Gonzalez

[11] Patent Number: 5,313,981

[45] Date of Patent: May 24, 1994

[54] LIQUID CONTROL APPARATUS

[76] Inventor: Miguel Gonzalez, 227 W. Janss Rd. - #250, Thousand Oaks, Calif. 91360

[21] Appl. No.: 71,953

[22] Filed: Jun. 7, 1993

[51] Int. Cl.[5] ..... F16K 11/24

[52] U.S. Cl. ..... 137/595; 68/207; 251/129.04

[58] Field of Search ..... 137/595; 251/129.04, 251/129.09; 68/207

[56] References Cited

U.S. PATENT DOCUMENTS

| | | | |
|---|---|---|---|
| 3,417,782 | 12/1968 | Mentnech | 68/207 X |
| 3,850,199 | 11/1974 | Stone et al. | 68/207 X |
| 3,868,968 | 3/1975 | Fuhrmann | 68/207 X |
| 4,611,626 | 9/1986 | Logsdon | 137/595 X |

FOREIGN PATENT DOCUMENTS

| | | | |
|---|---|---|---|
| 2627900 | 1/1978 | Fed. Rep. of Germany | 68/207 |

*Primary Examiner*—Stephen M. Hepperle
*Attorney, Agent, or Firm*—Jack C. Munro

[57] ABSTRACT

An actuation device sensitive to the flow of electricity from an electrical conductor from a source of electricity into an appliance. The appliance, upon being electrically activated, is to receive a flow of a fluid from a supply pipe. The actuation device to be connected to a valve mounted in conjunction with the supply pipe with this valve being movable from a closed position to an open position upon electricity being supplied to the appliance.

3 Claims, 1 Drawing Sheet

LIQUID CONTROL APPARATUS

BACKGROUND OF THE INVENTION

1) Field of the Invention

This invention relates to an apparatus which controls the flow of a plurality of sources of a liquid to an appliance in response to electrical activation of the appliance.

2) Description of Prior Art

The subject matter of the present invention will be discussed in relation to a conventional clothes washing machine that can be mounted either within a house or a commercial establishment.

The conventional washing machine includes an electrically operated timer mechanism which when activated causes the washing machine to operate through a duty cycle and then be shut off. The washing machine is to be supplied a source of hot water and a source of cold water. The supply of the water is conducted through hoses that connect between the washing machine and supply pipes mounted near the location of the washing machine. It is to be understood that the subject matter of this invention could be utilized in conjunction with any appliance which is electrically activated and is designed to receive one or more sources of a liquid or gas.

A conventional clothes washing machine utilizes two flexible hoses with one hose being connected to a cold water supply and the remaining hose being connected to a hot water supply. These hoses normally are continually subjected to water line pressure. It is advocated that faucets connecting to the hoses be turned to the off position when the washing machine is not being operated. However, most individuals do not turn the faucets to the off position during non-operation of their washing machine, but leave the faucets on which causes the water line pressure to be continually subjected to the hoses.

Within the home, most washing machines are located generally within the garage or in the interior portion of the house. If a flexible hose ruptures and leakage occurs, it does not take long for a substantial amount of water to flow within the residence or garage which will result in flooding of a portion, or all, of the residence or garage. The problem is particularly acute if the people that reside at the residence are away from the residence for a period of time, such as being on vacation. There is a need to utilize an automatic water flow apparatus in conjunction with the washing machine so that when the washing machine is manually activated to start its duty cycle, it is only then that the hot and cold water will be supplied to the washing machine. When the washing machine is turned off, the water is not supplied to the flexible hoses, thereby eliminating any possibility of flooding.

SUMMARY OF THE INVENTION

The structure of the present invention is directed to an after market product that can be purchased and used in conjunction with any installed washing machine or any other similar type of appliance. The washing machine is electrically activated by means of an electrical wire which terminates in a plug with this plug normally being connected to a receptacle which in turn is connected to an electrical conductor from a source of electricity. This plug is to be removed and installed in conjunction with an actuation device, with this device in turn being plugged into the receptacle. This actuation device is connected normally by electricity to a pair of valves, there being one valve installed within the hot water supply line to the washing machine and the other valve being installed within the cold water supply line of the washing machine. These valves are normally closed, not permitting flow of hot and cold water to the washing machine. When the timing mechanism of the washing machine is activated and electricity is caused to flow to the washing machine, the actuation device will sense the flow of electricity and immediately activate each of the valves opening both of these valves permitting the flow of hot and cold water to the washing machine. When the washing machine moves to a deactivated or off position, the actuation device will again sense the non-flow of electricity and permit these valves to move from the open position to the closed position, thereby not permitting flow of hot and cold water to the washing machine.

Previously there had been utilized automatic shut-off devices in conjunction with the water hoses connected to the washing machine. However, these automatic shut-off devices are complicated and frequently require modification of the structural arrangement of the washing machine itself in order to achieve usage.

One of the primary objectives of the present invention is to construct a shut-off control system for the water supply hoses to a washing machine that will only permit the water to be supplied to the washing machine when the washing machine is placed in an active position.

Another objective of the present invention is to construct an automatic shut-off water control apparatus for a washing machine which can be installed in conjunction with any washing machine as an after market product not requiring any special modification of the washing machine or the installation area of the washing machine.

Another objective of the present invention is to construct an automatic water control shut-off apparatus which is simple in construction and can be manufactured inexpensively and therefore sold to the ultimate consumer at an inexpensive price.

BRIEF DESCRIPTION OF THE EMBODIMENT

Figure 1:
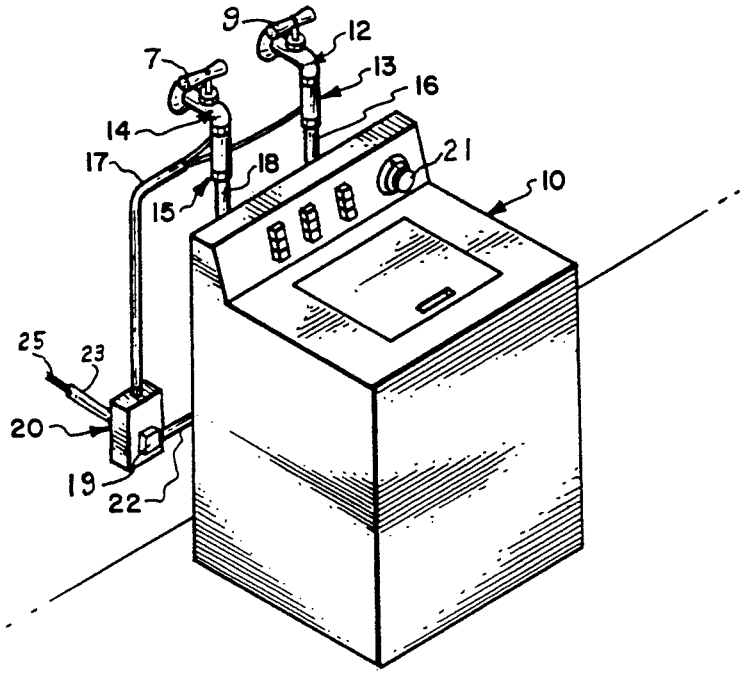
FIG. 1 is an isometric view showing the liquid control apparatus of the present invention installed in conjunction with a conventional washing machine installation.

Referring in particular to the drawing, there is shown a conventional washing machine 10 which has a manually operable electrical timing mechanism which will initiate the washing machine to operate through its duty cycle. Initiation of the operation of the washing machine 10 within the duty cycle is caused by turning of timer control knob 21. Electrical power is to be supplied to the electrical operating structure, which includes control knob 21, is through conduit 22. The free end of conduit 22 connects to a plug 19 with this plug 19 normally engaging with a conventional electrical receptacle (not shown) which in turn connects with conduit 23 which contains electrical wires 25 from the source of electricity which is also not shown. A typical source would be electrical power that is supplied within a house or a building.

In accordance with this invention, instead of the plug 19 connecting directly with the receptacle, it is to be electrically connected with female plug 26 which is mounted within the housing of an actuation device 20. The actuation device 20 also includes a male plug 24 which is to connect with this receptacle and thereby receive electrical power from the wires 25.

The actuation device 20 is electrically connected through conduit 17 to valves 13 and 15. Valve 13 is to be operated electrically as by a solenoid 106 with valve 15 being operated in a similar manner by solenoid 104. The solenoids 104 and 106 are deemed to be conventional. Also the valves 13 and 15 can take any form of valve structure that is desired that can be used to control the flow of a fluid such as a liquid through a pipe. The valve 13 is mounted onto a faucet 12 with valve 15 being mounted on a faucet 14. The faucet 12 includes a separate valve which is to be manually operated by turning of handle 9. In a similar manner faucet 14 includes an essentially identical valve which is again operable by manually turning of handle 7. The valves, operated by handles 7 and 9, are for the purpose of manually terminating the flow of liquid through the faucets 12 and 14. The faucet 12 will generally be connected to a cold water supply pipe (not shown) and faucet 14 will be connected to a hot water supply pipe (not shown). Even with the valves controlled by handles 7 and 9 open, their respective solenoid operated valves 15 and 13, when closed, will prevent flow of water into their respective connected hoses 18 and 16 and into the washing machine 10.

Figure 2:
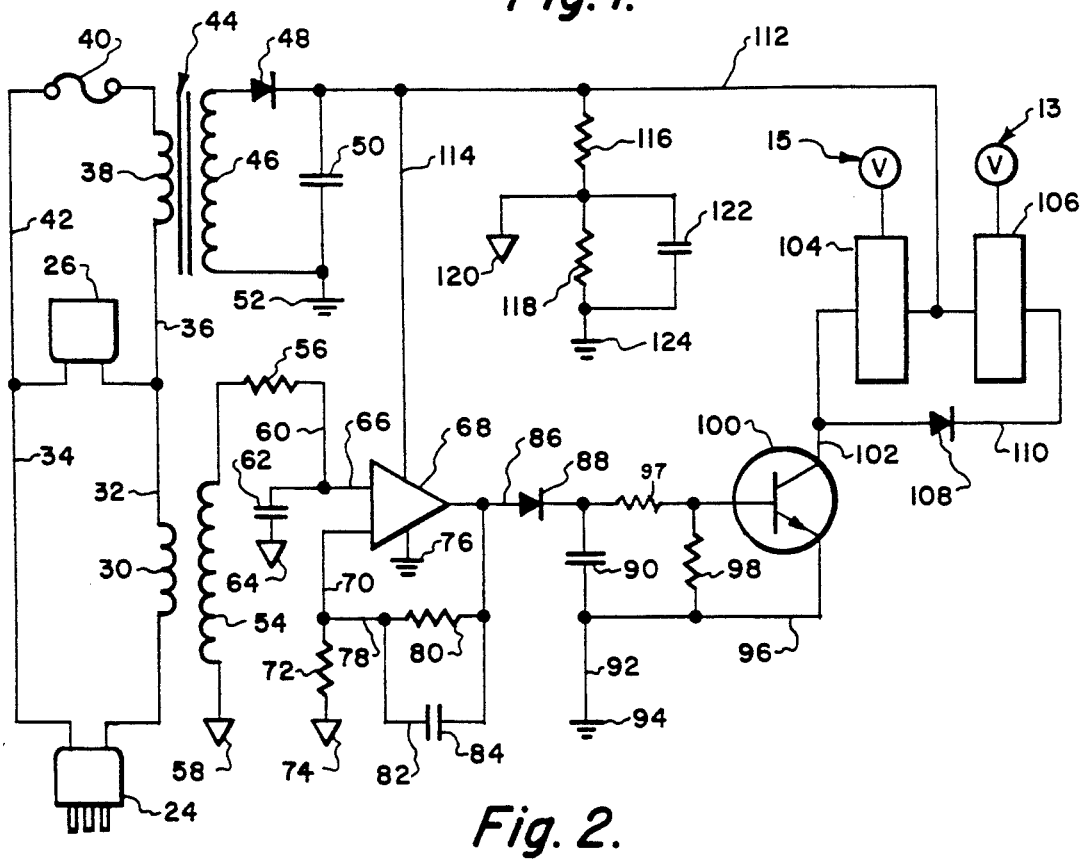
FIG. 2 is an electrical schematic view of the operation circuitry utilized in conjunction with the liquid control apparatus of the present invention.

There is an electrical circuit shown in FIG. 2 contained within the actuation device 20. This electrical circuit includes plugs 24 and 26 which are electrically connected together by means of grounding conductor 34 from plug 24 to plug 26 and positive conductor 32 from plug 24 to plug 26. Within the positive conductor 32 is located a coil 30. Coil 30 comprises the primary winding of a transformer. When current flows through the coil 30, this flow of current is sensed by the secondary winding 54 of the transformer.

When current is caused to flow from plug 24 to plug 26, this flow is also conducted through primary winding 38 of a transformer 44. The primary winding 38 is mounted within conductor 36 which is connected to conductor 32. Ground conductor 42 is connected to conductor 34. Located between the conductors 36 and 42 is a fuse 40. The sensing of the conducting of current within the primary winding 38 is picked up by secondary winding 46 of the transformer 44.

Through the transformer 44 there is provided the power for the circuit shown in FIG. 2 and the solenoids 104 and 106. The secondary winding 46 is connected through a diode 48 and capacitor 50 to provide the DC rectification and provide a nominal twelve volts to conductor 112 which connects with the solenoids 104 and 106. The winding 46 and the capacitor 50 are connected to the electrical ground 52 which is at zero volts. The twelve volts of power is supplied through conductor 114 to the operational amplifier 68. The combination of resistors 116 and 118 and capacitor 122 produce a phantom ground 120.

Resistor 118 and capacitor 122 are also connected to the zero ground 124. This phantom ground 120 produces a midpoint voltage of six volts which is to be supplied to locations 58, 64 and 74 within the circuit. The operational amplifier 68 is connected to the zero volt ground represented at 76 and also to the phantom ground of six volts which is supplied as a negative potential through conductor 70 to the operational amplifier 68. Resistor 72 is connected between conductors 70 and 78. Resistor 80 is mounted across conductor 82 which connects between the output conductor 86 of the operational amplifier 68 and the conductor 78. The size of the resistors 72 and 80 determine the gain of the operational amplifier 68 which needs to be sufficient to switch transistor 100 to an on position when a minimum of 200 milliamps is drawn through the coil 30. However the gain of the amplifier 68 can be adjusted to achieve any required threshold. Capacitor 84 is supplied to reduce noise within the circuit.

Secondary coil 54 feeds current into conductor 60 within which is mounted resistor 56. Conductor 60 connects to conductor 66 within which is mounted capacitor 62. Conductor 66 connects to the positive side of the operational amplifier 68 and supplies a positive six volts to the operational amplifier 68. The resistor 56 and the capacitor 62 comprise a low-pass filter to remove some of the noise which appears on the AC power line which is picked up by coil 54. The signal within conductor 66 is supplied to the non-inverting input of the operational amplifier 68. The output of the operational amplifier 68 is conducted through conductor 86, and through diode 88. Resistors 97 and 98 set the normal voltage at the base of the resistor 100 to somewhat less than 0.6 volts. The capacitor 90 functions to stabilize the six volts produced by the operational amplifier 68 so as to keep this voltage constant with no significant voltage fluctuations.

It is to be noted that inputs into the operational amplifier 68 constitute the twelve volts from conductor 112 and a positive six volts from conductor 66 and a negative six volts from conductor 70. The output from the operational amplifier 68, which comprises volts, is decreased to approximately 0.6 volts and is supplied to the base of the transistor 100 as previously mentioned.

When the output of the operational amplifier 68 becomes sufficiently high, the transistor 100 switches and this grounds the open side of the solenoids 104 and 106 through conductor 102. A conductor 110 connects between conductor 102 and the positive twelve volts of conductor 112. Within the conductor 110 is located a diode 108 for noise suppression.

The base of the transistor 100 is connected to conductor 96 which in turn connects to resistor 98 and conductor 92. Conductor 92 connects between the zero ground 94 and the capacitor 90. When the output of the operational amplifier 68 becomes sufficiently high, the transistor 100 switches and this grounds the open side of the solenoids 104 and 106 causing the solenoids 104 and 106 to be moved from their normally closed position to their open positions. This will then permit water to flow through hoses 16 and 18 into the washing machine 10.

What is claimed is:

1. In combination with an appliance, said appliance having operation means, said electrical operation means including a plug which is to connect with an electrical conductor which extends from a source of electricity which is to operate said electrical operation means, activation of said electrical operation means causes operation of said appliance, at least one liquid supply pipe located remote from said appliance, a hose interconnecting said pipe and said appliance, said electrical operation means being manually positionable in an activated position and a deactivated position, with said electrical operation means located in said deactivated position no liquid is permitted to flow through said pipe and said hose into said appliance, with said electrical operation means being located in said activating position liquid is permitted to flow through said pipe and said hose into said appliance, a liquid control apparatus comprising:

a valve mounted between said hose and said pipe, said valve being movable between a closed position and an open position, with said valve in said closed position no liquid can flow through said hose into said appliance, with said valve in said open position liquid is capable of flowing through said hose into said appliance; and an actuation device mounted between said plug and said electrical conductor, said actuation device being connected to said valve, upon activation of said electrical operation means said actuation device to cause said valve to move from said closed position to said open position permitting liquid to flow into said appliance, said actuation device including sensing means for sensing conducting of electrical energy to said electrical operation means, upon said sensing means sensing the conducting of electrical energy to said electrical operation means said actuation device causing said valve to move from said closed position to said open position.

2. The combination as defined in claim 1 wherein:

there being a plurality of said liquid supply pipes, there being a said valve for each said supply pipe.

3. The combinations found in claim 2 wherein:

each said valve being operable by a solenoid, there being a separate said solenoid for each said valve.

* * * * *